US006623353B1

(12) United States Patent
Akhtar et al.

(10) Patent No.: US 6,623,353 B1
(45) Date of Patent: Sep. 23, 2003

(54) VENTURI TYPE AIR DISTRIBUTION SYSTEM

(75) Inventors: Salman Akhtar, Mississauga (CA); Gerhard Granek, North York (CA)

(73) Assignee: Air Handling Engineering Ltd., Williamsville, NY (US)

( * ) Notice: Subject to any disclaimer, the term of this patent is extended or adjusted under 35 U.S.C. 154(b) by 0 days.

(21) Appl. No.: 10/139,880

(22) Filed: May 7, 2002

(51) Int. Cl.[7] ..... F24F 1/00

(52) U.S. Cl. ..... 454/233; 454/261; 454/234

(58) Field of Search ..... 454/233, 261, 454/263, 232, 234

(56) References Cited

U.S. PATENT DOCUMENTS

| | | | | | |
|---|---|---|---|---|---|
| 1,138,470 | A | * | 5/1915 | Hackney | 454/251 |
| 4,616,559 | A | * | 10/1986 | Barlow | 454/298 |
| 5,553,417 | A | * | 9/1996 | Chambers | 47/60 |
| 5,577,958 | A | * | 11/1996 | Kumekawa et al. | 454/233 |
| 6,213,867 | B1 | * | 4/2001 | Yazici et al. | 454/263 |
| 6,250,373 | B1 | * | 6/2001 | Vecchi et al. | 165/53 |

OTHER PUBLICATIONS

M & I Heat Transfer Products Ltd., M&I Induction Unit, Bulletin No. 7–1296 (1996), pp. 1–3,8–10,13, 14.
M & I Air Systems Engineering, "Heating, Ventilating and Cooling for Schools," Bulletin No. 11–0800 (2000), pp. 1–4.

* cited by examiner

*Primary Examiner*—Derek Boles
(74) *Attorney, Agent, or Firm*—Gifford, Krass, Groh, Sprinkle, Anderson & Citkowski, P.C.

(57) ABSTRACT

An air handling system for a building having a ceiling and enclosed space, the system including four interconnected induction units for mounting adjacent the ceiling. These units form four sides of a rectangular assembly. Each induction unit includes an air plenum section and an air mixing section connected to a side of the air plenum section and forming an elongate air mixing chamber that extends downwardly to an air outlet. Supporting members mount the induction unit assembly at the ceiling so that each air mixing section when viewed in transverse, vertical cross-section extends at a substantial angle, which in a preferred embodiment is about 90 degrees, to the ceiling during use of the apparatus. Return air is drawn by venturi effect created by a fast flow of primary air into each air mixing chamber and heated or cooled at the heat exchanging coils. The units can provide a mixed air flow that flows downwardly from the outlets.

21 Claims, 5 Drawing Sheets

VENTURI TYPE AIR DISTRIBUTION SYSTEM

BACKGROUND OF THE ART

This unit relates to an air handling system for a building and, in particular, such a system employing one or more induction units adapted to mix two air flows.

A variety of air handling systems for both large and small buildings are already known in the air handling industry. Air handling systems both for residential and commercial buildings can include the use of a central heating system that includes a fan unit capable of blowing heated air through air ducts that deliver the air to the various rooms of the building. When this system is used in conjunction with a central air conditioner, it is also capable of providing cool air to the various rooms through the air ducts. A relatively large fan is generally required for a large commercial or industrial building. Air silencers can be installed on both the inlet side and outlet side of these large fans to reduce the noise levels created by the operation of such fans.

It is also known to provide so called induction units that employ the venturi effect to mix together both return air from a building and primary air. The two air flows are mixed in a mixing chamber located adjacent an elongate air plenum with a primary air inlet at one end. Tapered nozzles extend into the mixing chamber and are connected to a wall of the air plenum. The return air from serviced space enters the mixing chamber which is flanked by the induction unit's coils on one side and the other sides of the enclosure of the unit. There is an opening on the heat exchanger side of the enclosure for entry of the return air. These units can typically be mounted on a wall of a room with the air plenum section located near the floor and the air outlet located at the top of the unit. Such induction units have at least several advantages including the ability to operate at very low noise levels since they do not employ any fans or similar air circulating devices. They can also be used in conjunction with both high pressure as well as low pressure air duct systems and they provide for a reasonably efficient mixing of the primary air and the return air.

Systems for delivering treated air to a room through an outlet located in the ceiling are already known. For example, U.S. Pat. No. 4,672,887 which issued Jun. 16, 1987 to Fred Sproul Sr. describes an air delivery system located above a horizontal ceiling in a dwelling. The air duct system delivers treated air to a valance/diffuser air system that can be located adjacent one wall of the dwelling. The conditioned or treated air is forced into the air delivery system by a blower of a conditioning unit such as a forced air furnace. At the wall the air is initially distributed lengthwise along an elongate horizontal chamber and then distributed through apertures in a downwardly direction. However, this known system does not use air induction units for mixing return air and primary air. In this known system the return air system is located beneath the floor of the dwelling.

More recent U.S. Pat. No. 5,577,958 issued to Mitsubishi Denki Kabushiki Kaisha in November, 1996 describes a ceiling-embedded cassette type air conditioner located above a decorative grate or panel through which return air can pass. A blower is located centrally in this air conditioner and it forces the return air through two or more heat exchangers located on the perimeter of the blower. The conditioned air is returned to the room through two or more outlets located at the ceiling level. Air directing plates can be positioned in the air outlets and these can direct the outflowing air to flow into the room at an angle to the horizontal. This known air conditioning system does not employ any induction unit that relies on the venturi effect and, because it employs a blower, it will be quite noisy when it is operating.

In commonly assigned U.S. Pat. No. 6,213,867 issued Apr. 10, 2001, there is described a venturi type air distribution system which is designed to be mounted in a ceiling of a room. In this known system, there are two induction units each of which has an air mixing section forming an air mixing chamber and an air plenum section mounted at an upper end of the air mixing section. Air nozzles extend into the air mixing chamber and are mounted on a side of the air plenum section. The air mixing section has an air outlet in the form of a slot formed at a lower end thereof and a side air inlet for permitting return air to flow through a side of the air mixing section. These two induction units are mounted so that each air mixing section extends at a substantial acute angle, such as an angle of about 45 degrees, to the ceiling during use of the system. With the use of these two units, the return air is drawn by a venturi effect created by the nozzles into each air mixing chamber and the two units are capable of delivering a mixture of primary air and return air through the air outlets to the enclosed space.

It is an object of the present invention to provide an improved air handling system for a building which employs four induction units forming a rectangular induction unit assembly and which is capable of mixing return air and primary air efficiently and quietly.

It is a further object of the present invention to provide an improved air handling apparatus for a building which comprises four induction units forming a rectangular or square assembly, can be manufactured and installed at a reasonable cost, and can be operated and maintained at a low cost.

SUMMARY OF THE INVENTION

According to one aspect of the invention, an air handling system for a building having a horizontally extending ceiling and an enclosed space comprises an induction unit assembly having four induction units for mounting adjacent the ceiling. Each of these units has an air mixing section forming a relatively long air mixing chamber, and an elongate horizontal extending air plenum section mounted adjacent an upper end of the air mixing chamber and having a primary air inlet formed therein, and air nozzles extending into the air mixing chamber and mounted on an upper side of the air mixing section. The air nozzles each have an inlet end located at the upper side and adapted to receive primary air from the air plenum section. The air mixing section has an air outlet formed at a lower end thereof and a side air inlet for permitting air to flow through a side of the air mixing section and into the air mixing chamber. The induction unit assembly is substantially rectangular or square in plan view. Each of the induction units is located on a respective one of the four sides of the assembly. Supporting members are provided to mount the induction units so that each air mixing section is located adjacent the ceiling during use of the system in the building. Also during use of this system, the return air is drawn by venturi effect created by the nozzles into each air mixing chamber. The induction units are capable of delivering a mixture of primary air, that passes through their plenum sections and the nozzles, and return air through the air outlets to the enclosed air space.

Preferably a heat exchanging coil unit is mounted adjacent to the side of each air mixing section so that the return air flowing through each side air inlet first passes through the respective coil unit in order to be heated or cooled thereby.

According to another aspect of the invention an air handling apparatus for a building having enclosed space includes four induction units adapted for mounting in a ceiling of the enclosed space and forming four sides of an induction unit assembly which is substantially rectangular or square in plan view. Each induction unit includes an air plenum section with a primary air inlet, an air mixing section connected to the air plenum section and forming an air mixing chamber which in transverse, vertical cross-section is elongate, and a series of air nozzles mounted on one side of the air mixing section and extending into the air mixing chamber. Each air mixing section has an air outlet in an end thereof spaced from the air plenum section and a side air inlet for permitting return air to flow through a side of the air mixing section in the region of the nozzles. Supporting members are provided to mount the induction unit assembly at or near the ceiling so that each air mixing section as seen in transverse, vertical cross-section extends at an angle of about 90 degrees to the ceiling during the use of the apparatus. Also, during use of this apparatus, the return air is drawn by venturi effect created by a fast flow of primary air from the nozzles into each air mixing chamber. The induction units are capable of providing air flows comprising a mixture of the primary air and return air at the air outlets.

According to still another aspect of the invention, an air handling system for a building having a ceiling and an enclosed space below the ceiling includes four induction units adapted for mounting adjacent the ceiling and forming four sides of an induction unit assembly which is substantially rectangular in plan view. Each of these units has a primary air intake section and an air mixing section that, during use of the system and when viewed in transverse, vertical cross-section extends downwardly at an angle of approximately 90 degrees to the ceiling to an air outlet formed at the lower end of the air mixing section. Each air mixing section also has a side air inlet for permitting return air to flow through a side thereof into an air mixing chamber of the induction unit. Supporting members are also provided for mounting the rectangular induction unit assembly so that the assembly is located adjacent the ceiling during use of the system in the building. During use of this system, the return air is drawn by a venturi effect into each air mixing chamber and the induction units are capable of delivering a mixture of primary air, taken from the primary air intake section, and return air through the air outlets to the enclosed space.

In one preferred embodiment, each primary air intake section comprises an elongate, horizontally extending air plenum mounted at an upper end of the air mixing chamber and having a primary air inlet formed in one end thereof.

According to yet another aspect of the invention, the invention comprises the combination of a building structure having an enclosed space and an air handling system capable of providing a mixture of primary air and return air to this enclosed space. The combination comprises a horizontal extending ceiling and walls forming the building structure and defining the enclosed space and four air induction units mounted adjacent the ceiling and forming an induction unit assembly which is substantially rectangular in plan view with each induction unit located on a respective side of the rectangle. Each induction unit has a primary air intake section and an air mixing section that, as seen in transverse cross-section, extends downwardly at an angle of about 90 degrees to the ceiling to an air outlet formed at a lower end of the air mixing section. Each air mixing section also has a side air inlet for permitting return air to flow through a side thereof into an air mixing chamber of the induction unit. Supporting frame members mount the induction units adjacent the ceiling. During use of this system, the return air from the enclosed space is drawn by a venturi effect created by each induction unit into the air mixing chambers and the four induction units deliver the mixture of primary air and return air through the air outlets to the enclosed space.

In one preferred embodiment, the induction units are about equal in size and the induction unit assembly is square in plan view.

Further features and advantages will become apparent from the following detailed description of a preferred embodiment, taken in conjunction with the accompanying drawings.

DESCRIPTION OF PREFERRED EMBODIMENTS

Figure 1:
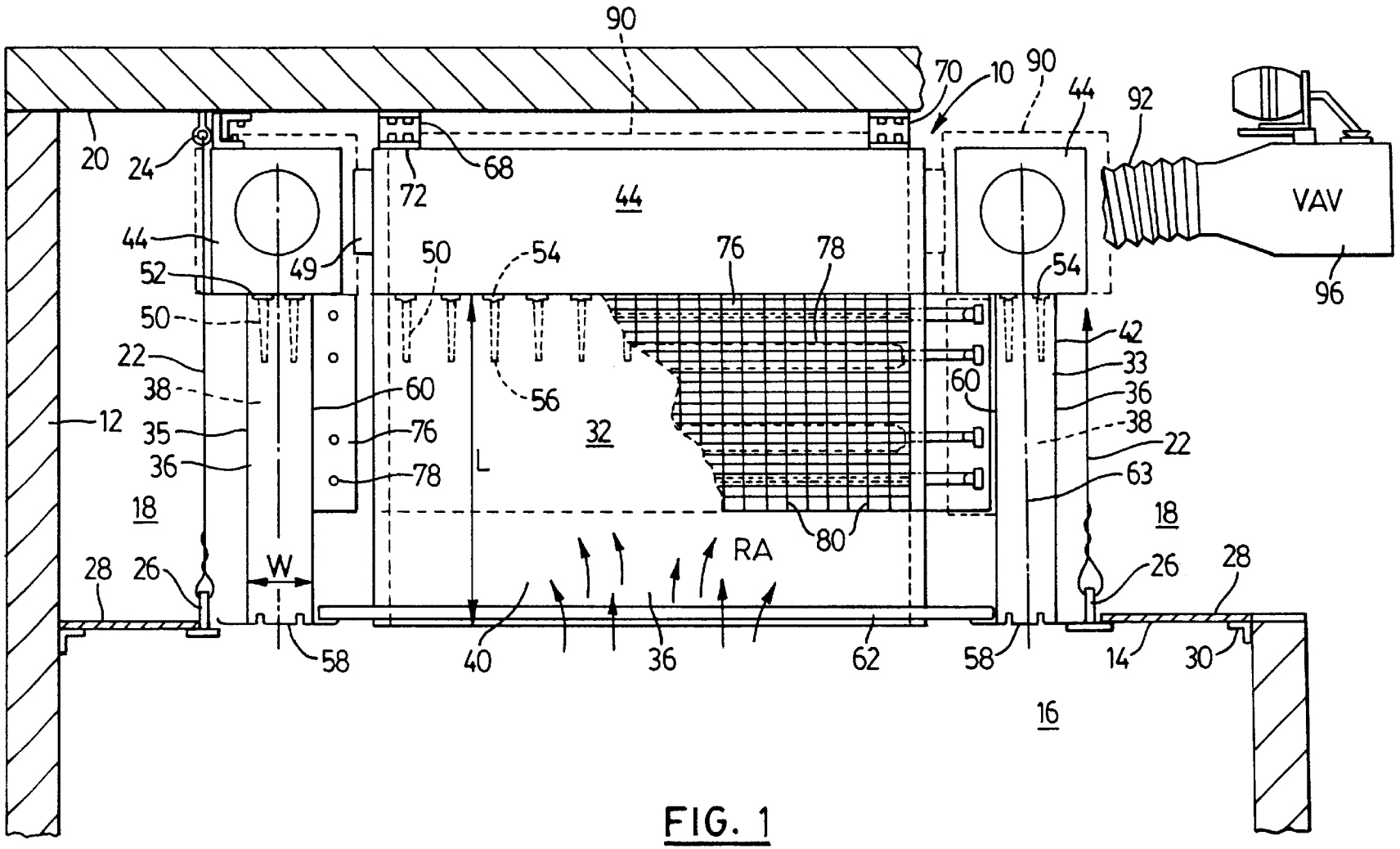
FIG. 1 is a cross-sectional elevation illustrating a first preferred air handling system constructed in accordance with the invention.

A preferred air handling system 10 constructed in accordance with the invention is illustrated in FIG. 1. This system is designed for use in a building 12, only a portion of which is shown for ease of illustration. One form of building in which it is believed the present invention will find particular application is a school building wherein the air handling system can be used in the ceiling of classroom, for example. The typical building 12 has a generally planar, horizontally extending ceiling which is located at the height indicated at 14 in FIG. 1 and an enclosed space 16, for example a room such as a classroom, is located below the ceiling. The preferred illustrated ceiling 14 is a type commonly referred to as a suspended ceiling that forms an enclosed space 18 between itself and a rigid structural or supporting ceiling 20 that may, for example, be made of concrete. The illustrated suspended ceiling is supported by vertically extending support wires 22 in a well known manner. Support wires can extend up to the structural ceiling 20 and can be firmly attached thereto by any known mechanism, for example the loop connector 24 shown. The wires 22 are commonly connected at the bottom end to a T-bar ceiling grid comprising a number of T-bar members 26. Generally these T-bar members extend both longitudinally and widthwise of the room, although, for ease of illustration, the illustrated T-bars 26 are shown extending in only one direction. These T-bars support a number of standard ceiling panels 28 which can be of predetermined length and width and, if necessary, cut to fit the required area. The outer perimeter panels 28 can be supported at their outer edges by any known means, such as by the illustrated angle members 30, or simply placing the edge of the panel on the top of the adjacent wall. Typical measurements for the standard ceiling panels are a width of about 2 feet and a length measuring 4 or 5 feet.

The preferred air handling system 10 illustrated in FIGS. 1 to 4 comprises four induction units 32 to 35, each adapted for mounting above the ceiling 14. These induction units form an induction unit assembly which is substantially rectangular in plan view as can be clearly seen from FIGS. 2 and 4 of the drawings. Indeed, in the illustrated preferred induction unit assembly of FIGS. 2 and 4, the four induction units are equal in size and in particular are equal in horizontal length and therefore the induction unit assembly is substantially square in plan view. Although the drawings illustrate a preferred arrangement wherein the induction units are equal in size, it is also possible to construct an assembly using induction units of different sizes to meet particular job requirements. Each induction unit 32 to 35 has an air mixing section 36 forming a relatively long air mixing chamber 38. As illustrated in FIG. 1, the length of the air mixing chamber is indicated by the distance marked L which is the length of each of two parallel side walls 40 and 42, which can be seen in FIG. 3. It will also be seen that this length L is the length of a transverse, vertical cross-section of the air mixing chamber which preferably is uniform in width and height in each of the induction units. The preferred length L is relatively long compared to the narrow width W of the chamber. Also the air mixing chamber is relatively long in a horizontal direction which is perpendicular to the transverse, vertical cross-section thereof. In one preferred embodiment of these induction units, the horizontal length of the air mixing chamber is about 24 to 26 inches, while the length L in this embodiment is about 16 inches.

Figure 2:
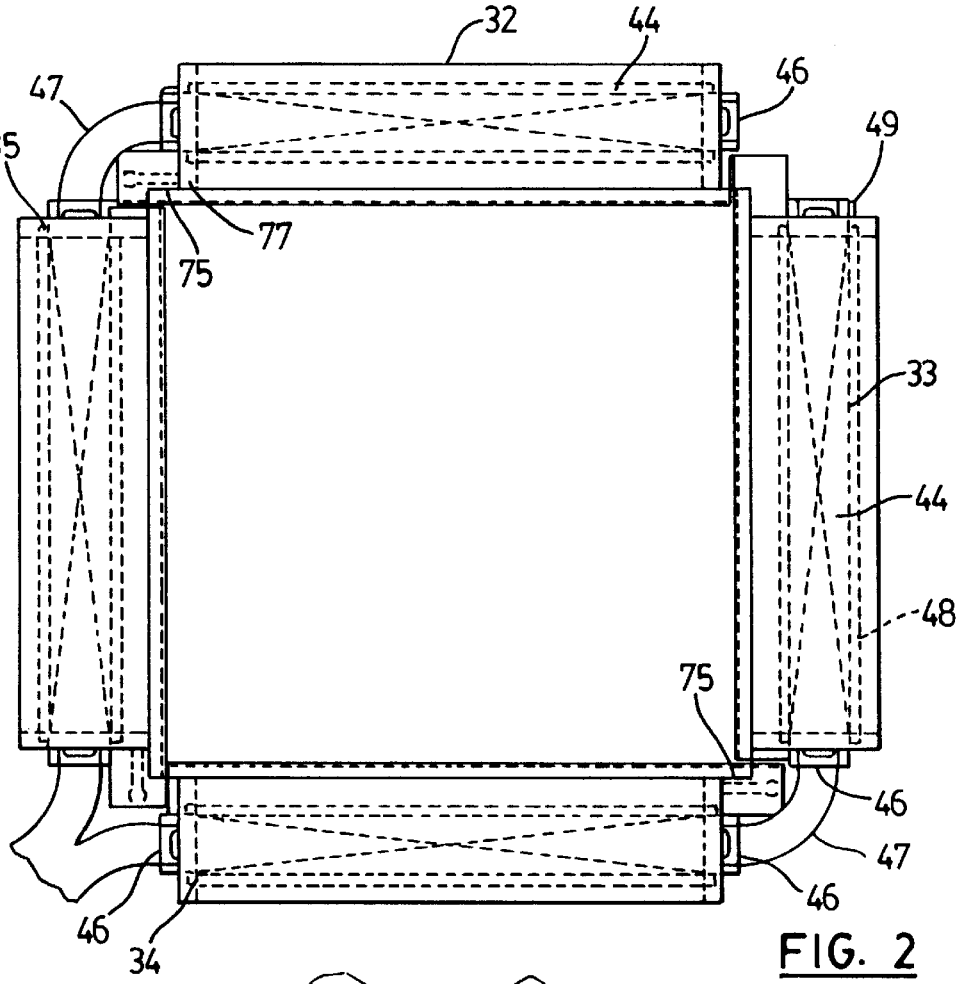
FIG. 2 is a top view of the induction unit assembly used in the air handling system of FIG. 1.
Figure 3:
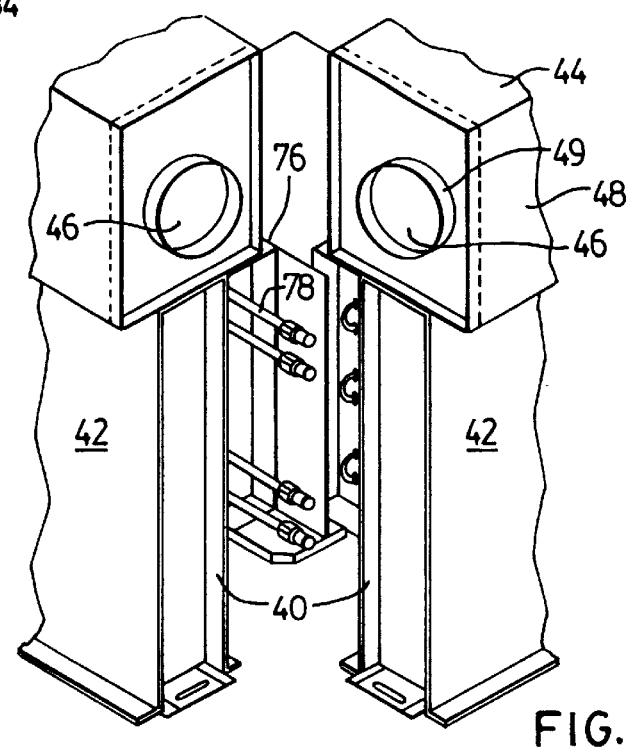
FIG. 3 is an isometric detail view showing a comer region of the assembly where two induction units meet.
Figure 4:
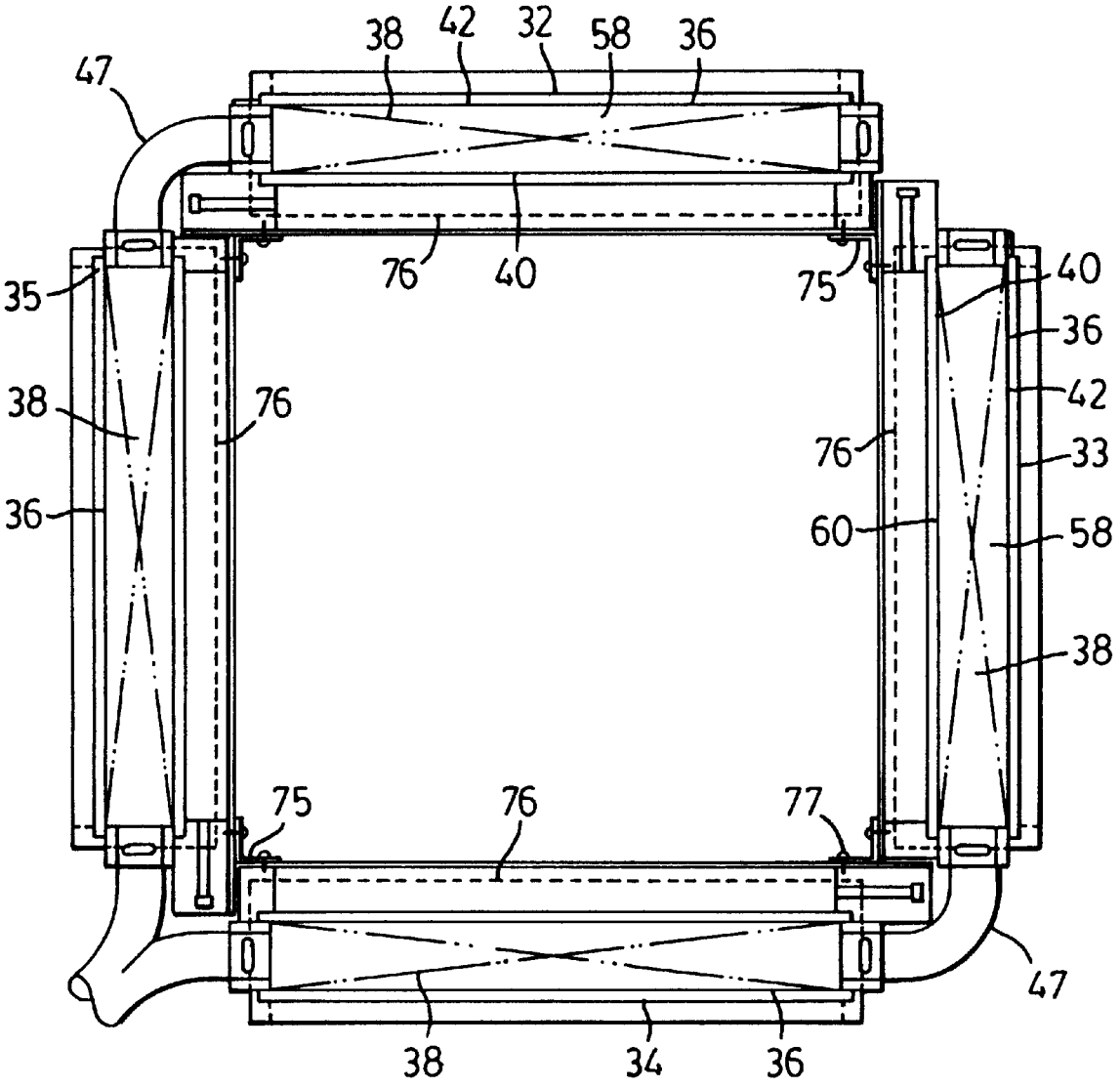
FIG. 4 is a bottom view of the induction unit assembly of FIG. 2, this view omitting the nozzles in each induction unit for ease of illustration.

Each induction unit has an elongate, horizontally extending air plenum section 44 mounted at an upper end of the air mixing chamber and having at least one primary air inlet 46 formed therein. In the illustrated preferred embodiment of the plenum section 44 there are in fact two circular openings formed at each end of the plenum section but normally only one of these openings is used as a primary air inlet. The opening at the opposite end can either be sealed shut so that air cannot escape therethrough or, if required, it can be connected by means of an elbow shaped pipe or tube to the primary air inlet 46 of the adjacent induction unit. These elbow-shaped connectors 47 are illustrated in FIGS. 2 and 4. Each of the openings formed at each end of the plenum section can be provided with a connecting flange 49 which can be seen clearly in FIG. 3. The plenum section forms an elongate, box-shaped plenum chamber 48.

One or more rows of air nozzles 50 extend into the air mixing chamber 38 and are mounted on an upper side 52 of the air mixing section. Each air nozzle has an inlet end 54 that is open to the plenum chamber 48 containing relatively high pressure primary air. In the illustrated preferred embodiment of each induction unit, there are in fact two rows of nozzles arranged side-by-side and extending substantially from one end of the air mixing chamber to the opposite end. Thus the rows of nozzles extend horizontally when the system has been installed. Preferably the nozzles themselves extend substantially vertically as illustrated in FIG. 1. A narrow passageway formed in each nozzle tapers inwardly from the inlet end 54 to the nozzle outlet at 56. In the preferred embodiment of the induction unit, the nozzles are made of plastic, for example polyethylene, or they can be made of metal such as bronze. If they are made of plastic, they are made to withstand elevated temperatures of as much as 160 degrees F. and more. In one preferred embodiment, the nozzle opening at the inlet end has a diameter of ¾ inch and the discharge outlet of the nozzle has a diameter between ¼ and ⅜ inch. This preferred nozzle causes only a low noise level during the operation of the induction unit. It will be understood that the size, shape and number of nozzles in the induction units can be varied by the system installer in order to meet the air handling requirements of a particular building. Furthermore, if necessary, the nozzles in one or two of the induction units can be different from the nozzles of the other induction units in order to provide different air flows from the induction units of the four unit assembly. In other words, if desired, the system can be customized to meet the requirements in the room above which the induction units are installed.

Each air mixing section 36 has a long, narrow outlet 58 formed at the bottom end thereof. The four elongate outlets of the assembly can be seen clearly in FIG. 4. In one preferred embodiment, the width of the air outlet is between 3 and 4 inches. With respect to the air plenum section in the embodiment of FIGS. 1 to 4, it can be square in cross-section with a height and width of 7 inches.

It should also be appreciated that although only one induction unit assembly comprising four induction units has been illustrated in FIG. 1, in the case of at least a larger room, it is possible to install, two, three or more of these induction unit assemblies at the ceiling level of the room and distributed in a suitable manner over the ceiling so the calculated air requirements for the room can be met.

A side air inlet 60 allows return air from the enclosed space or room 16 to flow through a side of the air mixing section 36 and into the air mixing chamber. Arrows indicating the upward flow of return air RA into a rectangular opening formed at the bottom end of the assembly are shown in FIG. 1. Preferably the rectangular opening in the bottom for the return air is covered by a suitable perforated grate or panel 62. The square or rectangular panel 62 can be of standard construction and can have reasonably large openings formed therein for easy passage of the return air. During use of this system, the return air is drawn by a venturi effect created by the nozzles 50 into each air mixing chamber. In this way each induction unit 32 to 35 is capable of delivering a mixture of primary air, that passes through the plenum sections 44 and the nozzles 50, and return air through their air outlets 58 to the enclosed air space.

As is clearly illustrated, it will be seen that the air induction units are so mounted and arranged that each air mixing section 36 having a vertical centerline at 63 extends vertically at a substantial angle to the horizontal ceiling located at 14 during use of the system. The preferred substantial angle between the vertical centerline 63 of the air mixing section and the horizontal ceiling is approximately 90 degrees resulting in the airflow exiting from the air outlet 58 substantially vertically downwards. In other words, each air mixing section 36 as seen in transverse, vertical cross-section extends downwardly at a substantial angle of approximately 90 degrees to the ceiling which is normally horizontal. It will be appreciated by those skilled in the art that by arranging four induction unit assemblies in a compact rectangular or square arrangement as described, including arranging each of the induction units so that their elongate air mixing sections extend vertically, each induction unit assembly requires only a relatively small amount of ceiling area in which to be mounted. In fact in a preferred embodiment of the induction unit assembly, the exterior horizontal dimensions of the assembly do not exceed four feet in either direction. In one preferred embodiment, each horizontal dimension of the assembly which is square in plan view is only 42.4 inches and the overall height of the assembly is less than 2 feet, namely 22.9 inches.

There are supporting members for mounting the induction unit assembly so that the bottom of the assembly extends horizontally and the centerlines 63 of the air mixing sections of the induction units extend vertically. It will be readily apparently to one skilled in the art that the induction unit assembly can be supported rigidly in a variety of ways. In the illustrated embodiment of FIG. 1, there are short, vertically extending support brackets 68 and 70 that extend down from the structural ceiling 20 and that are connected to the top of each induction unit 32 to 35. Each of these support brackets can have a horizontally connecting flange 72 that can be bolted to or attached by screws to the top of the air plenum section 44. Additional support frames or brackets can be provided if desired or if required in order to rigidly and securely support the induction units. The induction units themselves can be connected to one another at the comers of the assembly as illustrated in FIGS. 2 and 4. In particular right-angle brackets or connectors 75 can be used to rigidly connect each vertically extending end of each induction unit to an adjacent end of another induction unit of the assembly. These brackets can be attached to the induction units by means of suitable sheet metal screws 77.

Preferably a heat exchanging coil unit 76 is mounted adjacent to the inwardly facing sidewall of the air mixing section 36. The length and width of the heat exchanging coil unit can correspond approximately to the length and width of the rectangular air inlet 60 in order to achieve the full benefits of the heat exchanging coil unit but it is possible to make the coil unit smaller if a larger one is not required to satisfy the heating or cooling requirements of the induction unit. The return air flowing through the side air inlet 60 first passes through the coil unit in order to be heated or cooled thereby. Although the construction of these coil units can vary, the illustrated coil units comprise coolant pipes 78 that can extend back and forth to form horizontal pipe sections that are arranged in a vertically extending plane. A number of closely spaced heat exchanging metal fins 80 can be mounted on the coolant pipes 78 for a good heat transfer therebetween. The illustrated metal fins 80 are arranged in parallel, vertical planes and each of these fins extends perpendicular to the adjacent sidewall 40. Each heat exchanging unit 76 is mounted outside of the air mixing chamber 38 in order not to interfere with the mixing of the air and the flow of air through this mixing chamber.

In a preferred embodiment of the heat exchanging unit 76, the coolant pipes are made of copper tubes and the thin plates or fins 80 are made of aluminum. The coolant tubes should be suitable for a working pressure of up to 350 psig. Also it is desirable that each heat exchanging unit be equipped with a horizontally extending condensate pan or tray at its bottom end as known in the heat exchanging art in order to prevent condensate created by the heat exchanging unit from dripping down from the ceiling. This pan can either be non-drainable or can be drained by a suitable tube connection (not shown). As indicated in dash lines in FIG. 1, if the expected primary air entering the plenum section may be quite cool under some operating conditions, one, two or more sides of the air plenum section 44 can be covered with a layer of insulating material 90, for example, a flexible layer of neoprene. In the preferred embodiment illustrated in FIG. 1, the neoprene layer extends over the top of each air plenum section and also down the two vertically extending sides of this section.

In order to conduct primary air to the four air plenum sections 44, there can be provided one or more elongate air ducts 92, only a short section of one of these being illustrated in FIG. 1. This elongate air duct is connected to at least one and preferably two primary air inlets 46. A connection to one of these inlets is indicated by the dash-dot lines in FIG. 1. The air duct can either be a flexible tube type duct (which may be required if the duct must pass around a number of obstacles) or it can be a rigid sheet metal air duct of known construction. It will be appreciated that the air duct extends to a source of primary air such as a suitable fan system which can provide outside air at sufficient pressure to enable operation of each induction unit. The fan inlet can be connected to an opening in an exterior wall permitting outside air to flow in. In a preferred embodiment of this system, the incoming primary air flow that passes through the air duct 92 is split at one corner of the induction unit assembly by means of a Y-type connection. Thus, one branch of the Y can deliver the primary air to the air inlet 46 of one induction unit while the other branch of the Y connection delivers primary air to the primary air inlet of a second induction unit located at the same corner of the assembly. In a similar manner it is also possible to deliver primary air by means of two air ducts to two opposite corners of the four induction unit assembly. By using Y-type connections in this manner, it will be appreciated that it is possible to provide a balanced supply of air to the four induction units resulting in an equal amount of primary air (and return air) flowing through the four induction units and out of the air outlets 58.

In the illustrated embodiment of FIG. 1, a variable air valve 96 which per se is of known construction is connected to the air duct 92 and is capable of controlling the volume of primary air flowing through the air duct to the induction units. Preferably the air valve is a pressure independent type valve. Such a valve is shown and described in Canadian patent No. 1,237,359 issued May 31, 1988. The description and drawings of this Canadian patent are incorporating herein by reference. Of course, if more than one air duct 92 is being used to provide the primary air to the induction unit assembly, each of the air ducts 92 can be provided with its own variable air valve 96.

Figure 8:
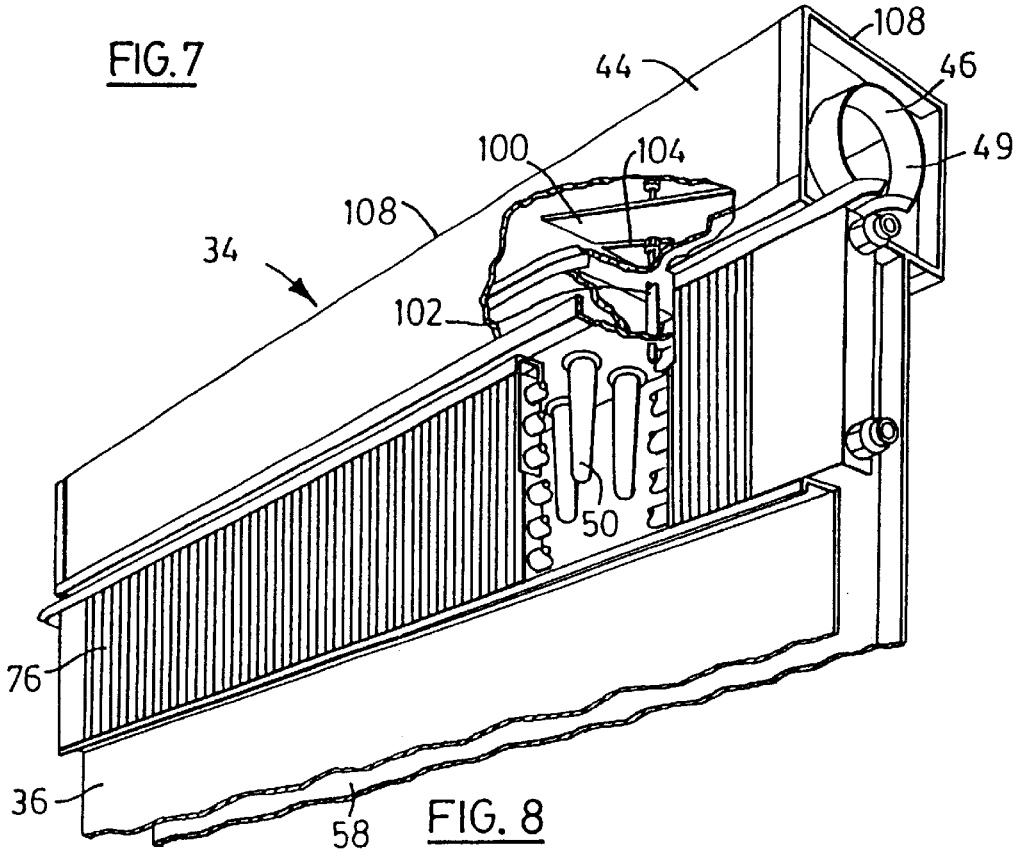
FIG. 8 is a perspective unit of one form of induction unit that can be used in the induction unit assembly of FIGS. 2 and 4.

It is also possible to provide a variable air volume control device located inside the induction unit itself and in particular inside the air plenum section 44. An air control device of this type is illustrated in FIG. 8, the device including an adjustable airflow restricting plate 100, the position of which is controlled by a control rod 102 that passes through an elongate, straight, slot 104 formed in the plate 100. By reason of nuts threaded onto the rod 102 and located on opposite sides of the plate 100, axial movement of the rod 102 can cause the plate 100 to pivot about hinges located at one end of the plate. By pivoting the plate 100 towards the top of the plenum section, the flow of primary air can be reduced and vice versa. Axial movement of the rod 102 can be accomplished manually by means of a standard electrical rotary actuator (ie. a servomotor).

It will be seen from FIG. 4 that in the preferred, illustrated embodiment of the induction air assembly, there are four elongate, rectangular air outlets 58. When the induction units are of equal size as shown in the drawings, these outlets form a square shape each outlet being located on one side of the square. Of course it is quite possible to construct the assembly so that two of the induction units on opposite sides of the assembly are longer than the other two units on the other two sides of the assembly. In this case the general shape of the outlets as seen in the bottom view is rectangular. In one preferred embodiment, the length of each outlet 58 is about 24 inches while the width of the outlet is between 3 and 4 inches.

Figure 5:
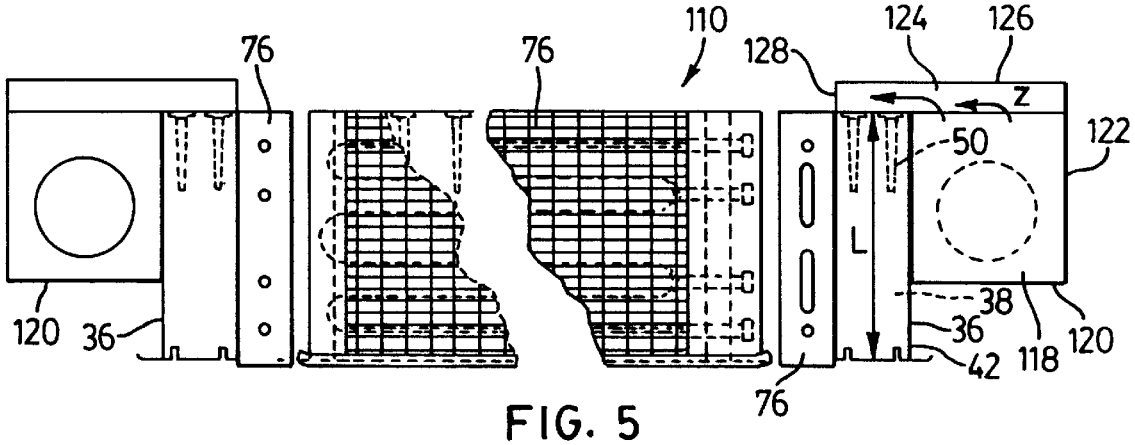
FIG. 5 is a partial front view of a second embodiment of an induction unit-type air handling system, this system being illustrated by itself without any supporting members connected thereto.
Figure 6:
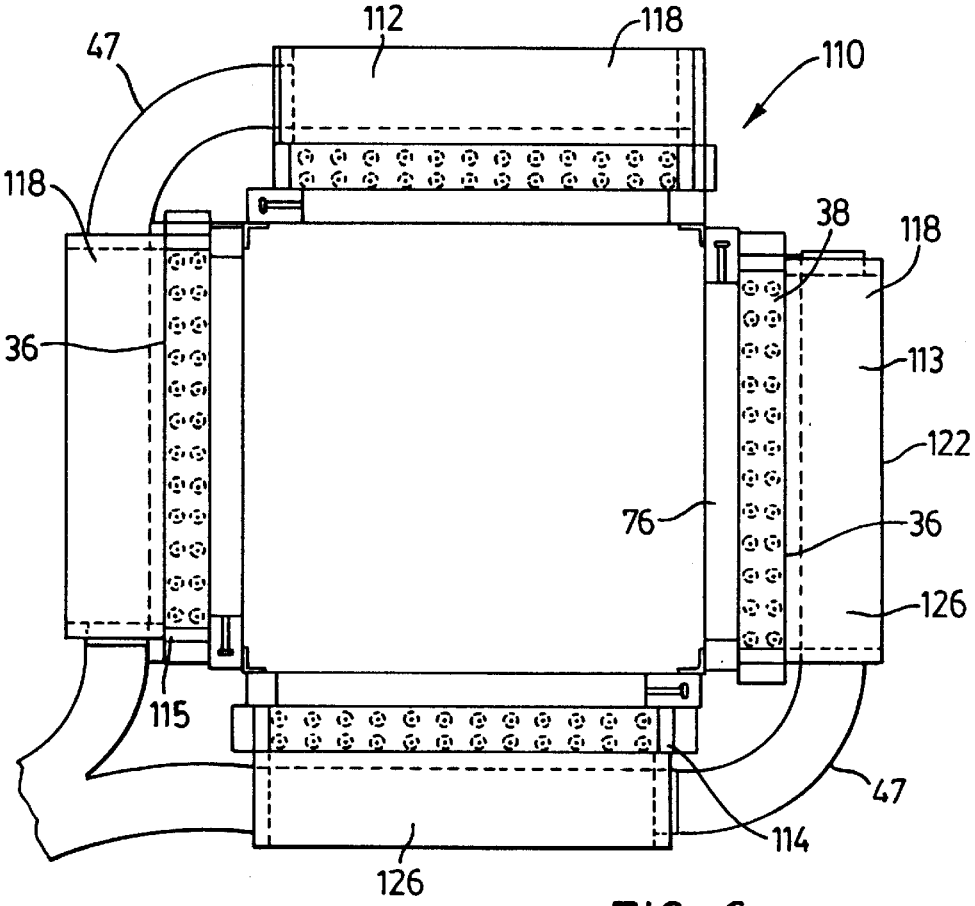
FIG. 6 is a top view of the second embodiment of the air handling system.
Figure 7:
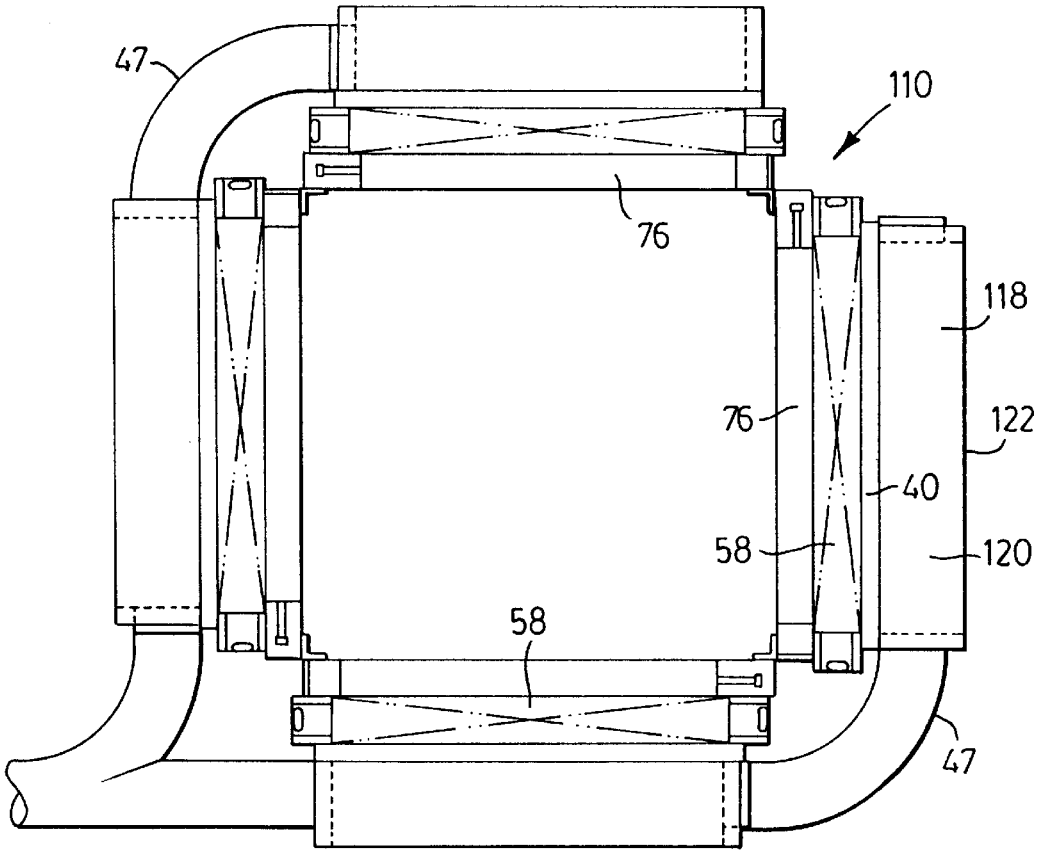
FIG. 7 is a bottom view of the second embodiment of the air handling system, this view omitting the nozzles in each induction unit for ease of illustration.

With the induction unit assembly illustrated in FIGS. 1 to 4, a reasonable amount of height is required between the ceiling level at 14 and the structural ceiling at 20 in order to accommodate the height of the induction units. In one typical embodiment of this type of air handling system, the total height of each induction unit assembly is about 23 inches and a small amount of additional room may be required to attach the assembly to the structural ceiling 20. If this much room is not available for the induction unit assembly, then a user of this system can employ the embodiment illustrated in FIGS. 5 to 7 of the drawings. In FIGS. 5 to 7, the same reference numerals will be used to indicate those features which are the same as in the embodiment of the induction unit assembly illustrated in FIGS. 1 to 4. This second embodiment of induction unit assembly is indicated generally at 110. The assembly includes four induction units 112 to 115, each of which has the same height, this height being generally lower than that of the units illustrated in FIGS. 1 to 4. Each of these induction units has an air mixing section 36 forming a relatively long air mixing chamber 38. Again the length L of this chamber measured in the vertical direction is relatively long compared to the narrow width of the chamber.

Each of the induction units has an elongate, horizontally extending air plenum section 118. The position of this air plenum section differs from the position of the air plenum section 44 in the first embodiment in that the major section of the plenum section 118 is located on the outer side of the air mixing section 36 rather than above the air mixing section. Each plenum section 118 has a bottom 120 connected to an outer wall 122. The inner wall of the air plenum section is provided by the vertical wall 42 of the air mixing section. At the top of the air plenum section 118 is a connecting duct section 124 that includes a top wall 126, this wall extending over the air mixing section 36. There is a relatively short vertical wall 128 which extends downwardly from the top wall to the top edge of the air mixing section. It will be understood that air is free to flow in the direction indicated by the arrow Z in FIG. 5 from the main portion of the air plenum section 118 into the region directly above the air mixing section 36 where the air can then flow downwardly through the nozzles 50.

Because of the location of the air plenum section 118 on each induction unit, the height of each induction unit can be relatively short. For example in one preferred embodiment, each induction unit has an overall height of approximately 12 inches.

It will be appreciated by those skilled in the air handling art that there are substantial advantages which can be gained by the use of the air handling system of the present invention. One advantage is the reduction in the primary air capacity that can be achieved. The amount of primary air required to supply a given size of enclosed space can be reduced by as much as 70% compared to a conventional air supply system.

When compared to the earlier two unit air handling system described in U.S. Pat. No. 6,213,867 issued Apr. 10, 2001, the advantages of the present four unit induction unit assembly include its ability to provide a larger concentration of cooled or heated air to a predetermined area in a room. In other words, the present induction unit assembly is more efficient in its use of the ceiling space (ie. it is capable of providing more cfm per square foot of ceiling). In addition, the present four unit assembly, wherein the induction units are arranged in the shape of a rectangle and each induction unit is upright, is more efficient from the standpoint of the heat exchangers because there is a more uniform flow of return air through the heat exchangers. In the previous two unit assembly wherein the heat induction units and their heat exchangers are arranged on a slope, for example a slope of 45 degrees, the return air flow must first enter a rectangular space below and between the two heat exchanging units and this can result in a less efficient, non uniform flow of the return air through the heat exchanging units.

An additional advantage of the induction unit assembly of the invention over the above-mentioned system is that different sizes of induction units can be combined in the present system, thus giving flexibility in system design and solutions that can be offered to the system users. Furthermore, the vertical orientation of each induction unit in the assembly is more suitable for the condensation drain which is normally provided. Moreover, because the present quad arrangement can be built to provide a higher air handling capacity, this will facilitate its use in rooms having higher heat load concentrations, such as computer rooms. Also, the assemblies of this invention can be constructed to suit different air handling loads on either side.

It will be understood by those skilled in the art that an air handling system constructed in accordance with the invention, for example a system designed for a school classroom, can be controlled by a known type of electrical control unit that provides for more than one mode of operation by the air handling system, for example, two different settings. The control unit can be set up so that there is a certain setting for when the room is occupied (in which case the air handling requirements would normally be greater) and another setting that would be used when the room is normally unoccupied. The control unit can be set up to operate a two position air valve with each position of the valve representing one of these two settings. Again the design of such a control system is well within the skill of those in the air handling industry and accordingly a detailed description herein is deemed unnecessary.

Although the illustrated induction units are provided with nozzles 50 that are of the same size throughout, it will be understood that it is possible to equip one, two or more of the induction units with nozzles that differ in size from the nozzles in the other induction units. By using larger nozzles in one or more of the induction units 32 to 35, it is possible to deliver a larger amount of primary air to those units that have the larger nozzles. It will be appreciated that one side of the room may require a greater air flow because of windows located on that side of the room whereas the opposite side of the room has no windows and therefore it is adjacent an area of the room that requires less heating or less cooling.

It is also possible to provide one, two or more of the induction units of the assembly with heat exchanging coil units 76 that differ in size from the heat exchanging coil units of the other induction units. By increasing the size of the heat exchanging coil unit, one will of course increase its ability to heat or cool the return air flowing therethrough. In some cases there may be no need for heat exchanging coil units on one or two of the induction units when the other induction units are provided with heat exchangers. For example, the region of the room adjacent an interior wall may require very little or no additional heating or cooling to be provided by the air handling system in the ceiling.

In some applications, one of the induction units can be set up so that its heat exchanger unit will only provide cooling air, for example to an inner region of the room while the other induction units are provided with a heat exchanger capable of providing either cooled air or warmed air to another region of the room, for example an area adjacent an exterior wall. Depending on expected outside climate conditions and other factors such as adjacent rooms, hallways, etc. the air handling engineer may determine that an interior region of the room will likely never require additional heating from the ceiling mounted air handling system but may, for example, in mid-summer, require additional cooling to be provided by the closest induction unit of the assembly.

Although FIG. 1 illustrates the induction unit assembly as mounted above the level of the ceiling 14, it will be appreciated that these induction units can also be mounted below but adjacent to the ceiling of the room, if desired. In the latter case, the space surrounded by the four outlet slots can either be left open or can be covered on the bottom by means of a suitable perforated grate or panel similar to that illustrated in FIG. 1.

The air handling system of the invention can be used with induction changeover two type, induction non-changeover two pipe or induction four pipe systems, all of which are known per se in the air handling art. In an induction changeover two pipe system, a change in the supply of water to the heat exchanging units is often carried out simply by closing or opening a suitable valve which can be done manually. After the changeover, for example in the fall, the heat exchanger units 76 can be used for heating while, after the changeover in the spring, the heat exchangers can be used for cooling. In the case of an induction non-changeover two pipe system, there is generally a central heating system that is capable of heating the air to a temperature in the range of 55 to 90 degrees F. and this central system is capable of providing air of this temperature year-round. In this system, the heat exchanger units are simply used to reheat the return air, when required. In the four pipe system, there are two separate heat exchanging units mounted on some or all of the induction units with one of the heat exchanger units provided for heating when required and the other heat exchanging unit provided for cooling.

In many of the installations employing the air handling system of this invention, the primary air supplied to the induction units will first be dehumidified and cooled in a central air apparatus installed at a suitable location in the building. The cooling-dehumidifying coil of the central air apparatus should precede the zone or building reheat coil. The latter may be required, depending on climatic conditions and the percentage of outside air. A humidifier may also be provided in the air supply system, preferably at the location of the central air apparatus.

In the case of air conditioning applications employing the present air handling system and a VAV valve, the valve controller should be deactivated by the user as a first step in providing for cool down and dehumidification after night shut down of the system in order to avoid condensation problems. The VAV valve controller must be shut off as it is only temperature sensitive.

As will be apparent to those skilled in the art in the light of the foregoing disclosure, many alterations and modifications are possible in the practice of this invention without departing from the spirit or scope thereof. The foregoing description is of the preferred embodiments by way of example only, and is not to limit the scope of the invention.

What is claimed is:

1. An air handling system for a building having a horizontally extending ceiling and an enclosed space, said system comprising:

an induction unit assembly having four induction units for mounting adjacent said ceiling, each of said units having an air mixing section forming a relatively long air mixing chamber, an elongate, horizontally extending air plenum section mounted adjacent an upper end of said air mixing chamber and having a primary air inlet formed therein, and air nozzles extending into said air mixing chamber and mounted on an upper side of said air mixing section, said air nozzles having each an inlet end located at said upper side and adapted to receive primary air from said air plenum section, wherein said air mixing section has an air outlet formed at a lower end thereof and a side air inlet for permitting return air to flow through a side of said air mixing section and into said air mixing chamber, said induction unit assembly being substantially rectangular or square in plan view, each of said induction units being located on a respective one of the four sides of the assembly, supporting members for mounting said induction units so that each air mixing section is located adjacent said ceiling during use of the system in the building, wherein during use of said system, said return air is drawn by a venturi effect created by said nozzles into each air mixing chamber and said induction units are capable of delivering a mixture of primary air, that passes through their plenum sections and said nozzles, and return air through the air outlets to said enclosed air space.

2. An air handling system according to claim 1 including a heat exchanging coil unit mounted adjacent to said side of each air mixing section, wherein said return air flowing through each side air inlet first passes through the respective coil unit in order to be heated or cooled thereby.

3. An air handling system according to claim 2 including an elongate air duct connected to the primary air inlets of the induction units and a variable pressure independent air valve connected to said air duct and capable of controlling the volume of primary air flowing into said induction units.

4. An air handling system according to claim 2 wherein each induction unit has two opposite ends which extend substantially vertically and each end of each induction unit is connected to an adjacent end of another induction unit of the assembly by at least one angle bracket and threaded connectors.

5. An air handling system according to claim 1 wherein said supporting members are adapted to mount said four induction units so that each air mixing section as viewed in transverse, vertical cross-section extends at a substantial angle of approximately 90 degrees to said ceiling during use of the system in said building.

6. An air handling system according to claim 5 wherein the longitudinal centerlines of the two air outlets of each pair of induction units positioned along opposite sides of said assembly are spaced apart by a distance of at least three feet.

7. An air handling system according to claim 2 wherein said induction unit assembly has exterior horizontal dimensions that do not exceed four feet by four feet.

8. An air handling apparatus for a building having an enclosed space, said apparatus comprising:

four induction units adapted for mounting in a ceiling of the enclosed space and forming four sides of an induction unit assembly which is substantially rectangular or square in plan view, each induction unit including an air plenum section with a primary air inlet, an air mixing section connected to said air plenum section and forming an air mixing chamber which in transverse, vertical cross-section is elongate, and a series of air nozzles mounted on one side of said air mixing section and extending into said air mixing chamber, each air mixing section having an air outlet in an end thereof spaced from said air plenum section and a side air inlet for permitting return air to flow through a side of said air mixing section in the region of said nozzles; and supporting members for mounting said induction unit assembly at or near said ceiling so that each air mixing section as seen in transverse, vertical cross-section extends at an angle of about 90 degrees to said ceiling during use of said apparatus;

wherein, during use of said apparatus, said return air is drawn by venturi effect created by a flow of primary air from said nozzles into each air mixing chamber and said induction units are capable of providing air flows comprising a mixture of said primary air and return air at said air outlets.

9. An air handling apparatus according to claim 8 including one or more variable air volume control devices adapted to control the volume of primary air passing through the air plenum sections and through the series of air nozzles and wherein said induction unit assembly is substantially square in plan view.

10. An air handling apparatus according to claim 8 wherein a heat exchanging coil unit is mounted adjacent each side air inlet and outside the adjacent air mixing chamber, each coil unit being provided to heat or cool return air flowing through its respective air inlet during use of said apparatus.

11. An air handling apparatus according to claim 9 wherein said one or more air volume control devices are adjustable air dampers mounted within the air plenum sections.

12. An air handling apparatus according to claim 10 wherein each induction unit has two opposite ends that extend substantially vertically and each of said ends is rigidly connected to an adjacent end of another induction unit of the assembly.

13. An air handling apparatus according to claim 9 wherein said induction unit assembly has exterior dimensions of approximately four feet by four feet.

14. An air handling apparatus according to claim 9 including an elongate air duct connected to the primary air inlets of the induction units and adapted to extend to a source of primary air, wherein said one or more air volume control devices comprises a variable, pressure independent air valve connected to said air duct at a location spaced away from said induction units.

15. An air handling system for a building having a ceiling and an enclosed space below said ceiling, said system comprising:

four induction units adapted for mounting adjacent said ceiling and forming four sides of an induction unit assembly which is substantially rectangular in plan view, each of said units having a primary air intake section and an air mixing section that, during use of said system and when viewed in transverse, vertical cross-section extends downwardly at an angle of approximately 90 degrees to said ceiling to an air outlet formed at a lower end of the air mixing section, each air mixing section also having a side air inlet for permitting return air to flow through a side thereof into an air mixing chamber of the induction unit; and supporting members for mounting the rectangular induction unit assembly so that said assembly is located adjacent said ceiling during use of the system in the building, wherein during use of the system, said return air is drawn by a venturi effect into each air mixing chamber and said induction units are capable of delivering a mixture of primary air, taken from the primary air intake sections, and return air through the air outlets to said enclosed space.

16. An air handling system according to claim 15 wherein each primary air intake section comprises an elongate, horizontally extending air plenum mounted at an upper end of said air mixing chamber and having a primary air inlet formed in one end thereof.

17. An air handling system according to claim 15 including a heat exchanging coil unit mounted adjacent to said side of each air mixing section, wherein said return air flowing through each side air inlet first passes through the respective coil unit in order to be heated or cooled thereby.

18. The combination of a building structure having an enclosed space and an air handling system capable of providing a mixture of primary air and return air to said enclosed space, said combination comprising:

a horizontally extending ceiling and walls forming said building structure and defining said enclosed space;

four air induction units mounted adjacent said ceiling and forming an induction unit assembly which is substantially rectangular in plan view with each induction unit located on a respective side of the rectangle, each of said induction units having a primary air intake section and an air mixing section that as seen in transverse cross-section extends downwardly at an angle of about 90 degrees to said ceiling to an air outlet formed at a lower end of the air mixing section, each air mixing section also having a side air inlet for permitting return air to flow through a side thereof into an air mixing chamber of the induction unit; and supporting frame members mounting said induction units adjacent said ceiling, wherein, during use of said system, said return air from said enclosed space is drawn by a venturi effect created by each induction unit into the air mixing chambers and the four induction units deliver said mixture of primary air and return air through their air outlets to said enclosed space.

19. The combination of claim 18 wherein said induction units are about equal in size and said induction unit assembly is square in plan view.

20. The combination of claim 19 wherein said induction unit assembly has exterior horizontal dimensions of approximately four feet by four feet.

21. The combination of claim 18 wherein each induction unit assembly has two opposite ends that extend substantially vertically and each of said ends is rigidly connected to an adjacent end of another of the induction units.

* * * * *